United States Patent [19]

Bunce

[11] Patent Number: 4,800,690

[45] Date of Patent: Jan. 31, 1989

[54] STACK SYSTEM

[75] Inventor: James W. Bunce, Sittingbourne, England

[73] Assignee: Kaldair Limited, London, England

[21] Appl. No.: 220,941

[22] Filed: Jun. 24, 1988

Related U.S. Application Data

[63] Continuation of Ser. No. 717,129, Mar. 28, 1985, abandoned.

[30] Foreign Application Priority Data

Mar. 30, 1984 [GB] United Kingdom ..... 8408349

[51] Int. Cl.[4] ..... E04H 12/20

[52] U.S. Cl. ..... 52/146; 110/184; 98/58

[58] Field of Search ..... 52/146–152; 110/184; 98/58

[56] References Cited

U.S. PATENT DOCUMENTS

| | | | |
|---|---|---|---|
| 795,332 | 7/1905 | Broome | 52/218 |
| 956,897 | 5/1910 | Henry | 52/146 |
| 2,645,315 | 7/1953 | Frushour | 189/26 |
| 2,693,255 | 11/1954 | Dicke et al. | 189/31.5 |
| 2,705,061 | 3/1955 | Getz | 189/13 |
| 3,013,640 | 12/1961 | Nehrbass | 189/12 |
| 3,020,985 | 2/1962 | Turner | 189/19 |
| 3,119,471 | 1/1964 | Turner | 189/12 |
| 3,248,831 | 5/1966 | Jones | 52/121 |
| 3,574,982 | 4/1971 | Wakonig | 52/148 |

FOREIGN PATENT DOCUMENTS

| | | | |
|---|---|---|---|
| 680540 | 8/1939 | Fed. Rep. of Germany | 52/146 |
| 1124222 | 2/1962 | Fed. Rep. of Germany | 52/146 |
| 1039144 | 8/1966 | United Kingdom . | |
| 1162856 | 8/1969 | United Kingdom . | |
| 1316565 | 5/1973 | United Kingdom . | |
| 1382441 | 1/1975 | United Kingdom . | |
| 1480471 | 7/1977 | United Kingdom . | |

*Primary Examiner*—James L. Ridgill, Jr.
*Attorney, Agent, or Firm*—Morgan & Finnegan

[57] ABSTRACT

A guyed stack has a system of horizontal rings and vertical struts surrounding it to which the guy wires are attached. The rings and struts allow free expansion and contraction of the stack. The vertical struts support the vertical components of the guy tensions. The stack supports wind induced bending moments and shear forces. Friction between the stack surface and the horizontal rings under wind induced motion acts as a damping mechanism to suppress the motion and reduce the risk of dynamic instability.

7 Claims, 4 Drawing Sheets

2
3
5
5
2
3a
3a
1
4
3
4
3b
2
3b 4
3
4
2
3
1
3
4

3
2
3
1
3

STACK SYSTEM

This is a continuation of co-pending application Ser. No. 717,129, filed on Mar. 28, 1985 now abandoned.

This invention relates to a stack system.

Tall flare stacks and vent pipes which are constructed in oil refineries and other industrial or petrochemical plants often require support against wind loads. This support can be provided by sets of guy wires anchored to the ground and attached to the stack. If the stack is subject to large temperature variations due to process operations or to the environmental conditions, it may not be possible to obtain a guy wire configuration which will remain at the correct tensions in the presence of the thermal movements of the stack.

In such cases it is usual to surround the stack by a lattice frame of steel members. The guy wires are attached to this lattice frame and the enclosed stack is free to expand or contract without affecting the guy tensions. However, lattice support frames of this type are expensive to construct. Also, they increase the surface area presented to the wind so that the wind forces acting on the assembly are increased. Ice accretion on the lattice frame can increase wind loading further and the overall weight of the structure.

None of the stack systems proposed thus far has proven completely satisfactory from the viewpoint of cost, installation and maintenance.

The present invention relates to a stack system that is cheaper to construct than a conventional lattice frame. It presents a relatively smaller surface area to wind loads and ice loads with consequently reduced guy forces and foundation loads. Also the friction forces set up between system components tends to reduce aerodynamic instability by damping.

Thus according to the present invention there is provided a stack system comprising a vertical stack having one or more elongate struts extending along and being spaced apart from the stack, the struts being capable of transmitting downward forces to the ground, a plurality of rings spaced apart from each other and attached to the struts, the rings encircling the stack, and flexible guy wires between one or more of the rings or struts and the ground.

The vertical stack may be a flare stack, vent stack, chimney or aerial or other similar type of structure. The elongate struts may be of any suitable cross-sectional shape and are preferably fabricated from metal. The struts may bear directly or indirectly onto the ground or foundation. The struts are preferably equi-spaced around the stack, for example, in the form of three equi-spaced struts at the corners of a triangle.

The rings are preferably equi-spaced along the struts and may be attached to the struts by welding, bolting or other suitable means. The rings are preferably fabricated from metal. The rings are located close to or touching the stack so that, when the stack moves say under wind motion, friction between the stack surface and the rings acts as a damping mechanism to suppress the motion and reduce the risk of dynamic instability.

It is envisaged that the stack system disclosed can be used with a multi-stack configuration or array of stacks. In particular, in the case of a main stack and an adjacent or adjacent ancillary stack, the rings may be staggered relative to each other in the vertical plane, the ring or rings on the main stack being tied preferably by a solid rod or rods to the body of the adjacent stack.

The invention will now be described by way of example only and with reference to FIGS. 1 to 6 of the accompanying drawings in which.

Figure 6B:
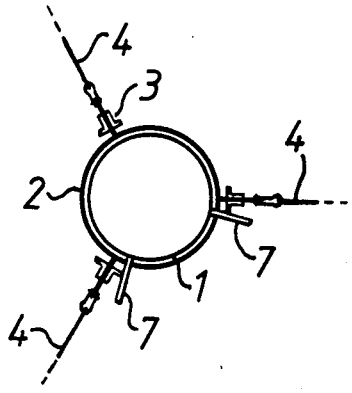
Figure 6A:
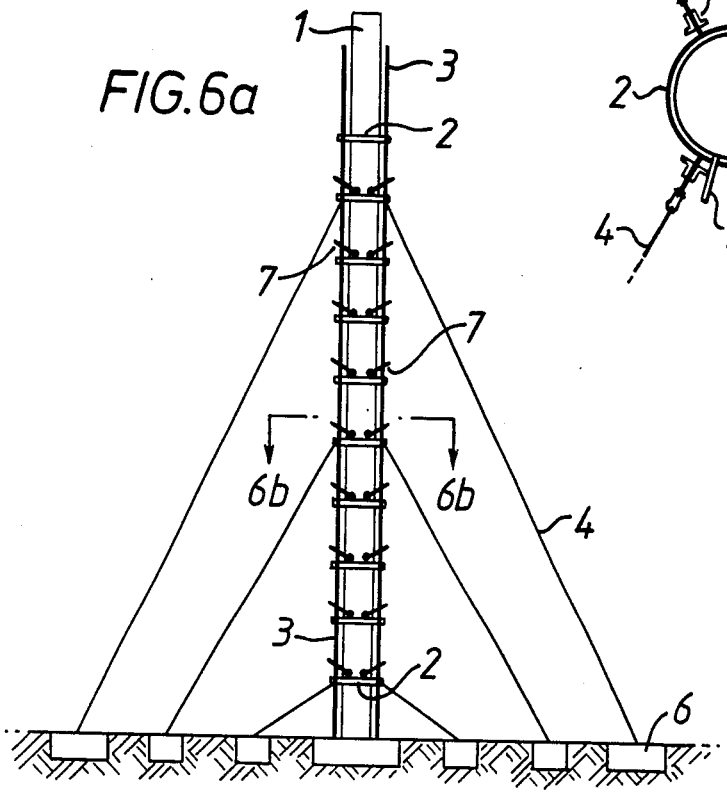

FIGS. 6(*a*) and 6(*b*) shows a guyed stack having anti-buckling guides, FIG. 6(*a*) being an elevation and FIG. 6(*b*) being a horizontal section across the stack system.

Figure 1:
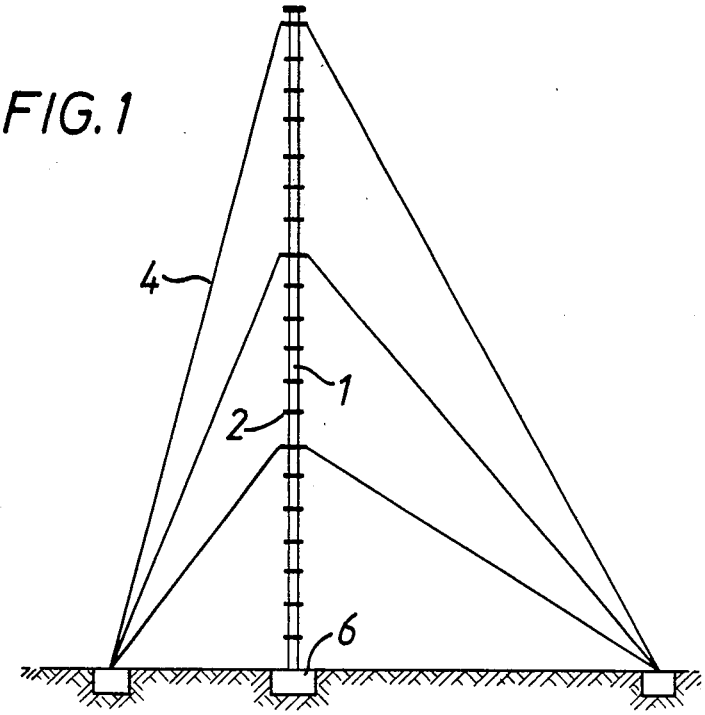
FIG. 1 shows on elevation an overall view of the guyed stack.
Figure 2:
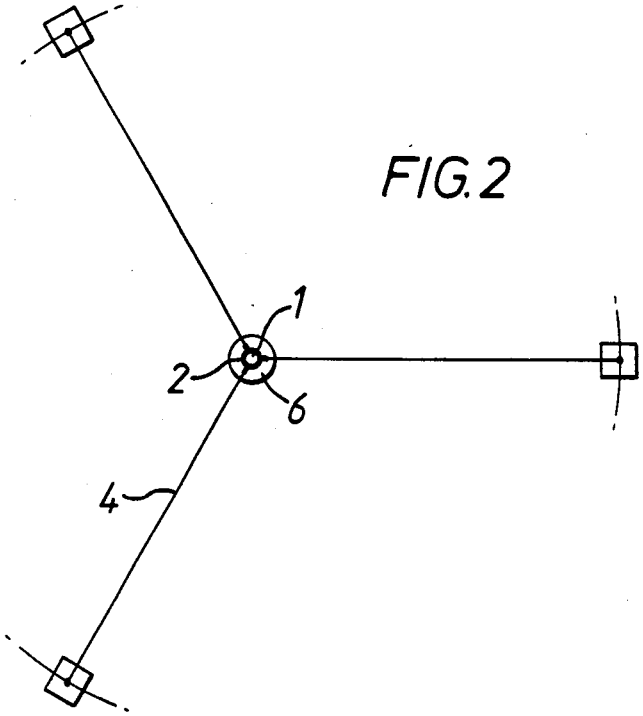
FIG. 2 shows on plan an overall view of the guyed stack and its foundations.

Referring to FIGS. 1 and 2, the guyed stack 1 has circular rings 2 at intervals up its height. These rings are held in position by vertical struts 3 equispaced around the circumference of the rings. The inner faces of the rings are close to the outer surface of the stack and may even touch it but are not attached to it. The stack is thus free to expand or contract inside the rings. Guy wires 4 are attached to lugs on some of the rings. The number of guy levels and the number of guys at each level depends upon the overall height of the stack and on the wind speeds which may be encountered in the design life of the structure.

The function of the vertical struts 3 is to hold the rings 2 in position and to transmit the vertical components of the guy tensions down to the stack foundations 6. The spacing between the rings is thus determined by the buckling strength of the vertical struts.

Figure 3:
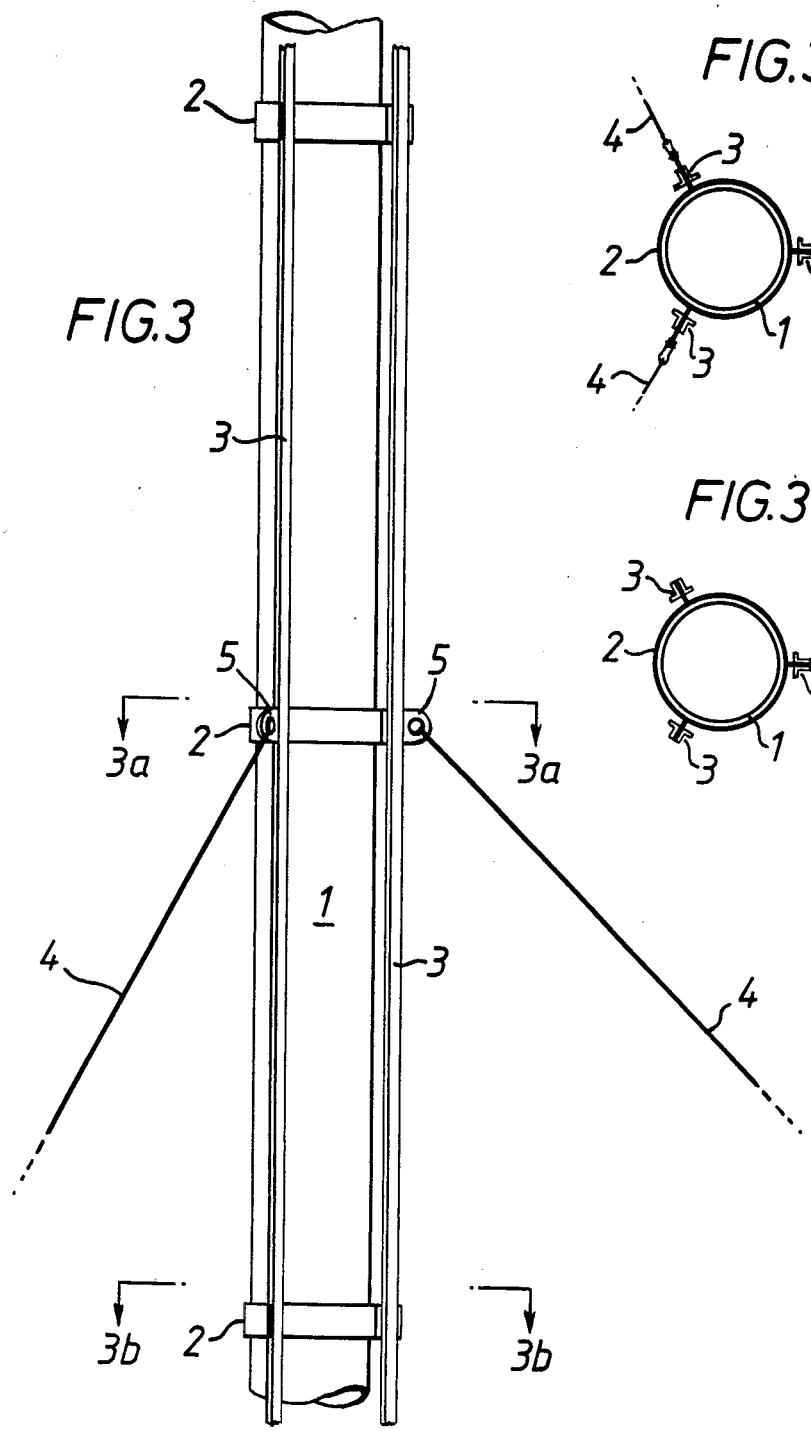
FIG. 3 shows schematic details of the stack system.
Figure 3A:
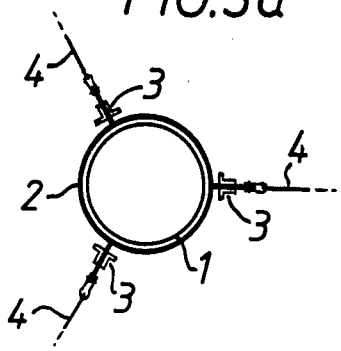
Figure 3B:
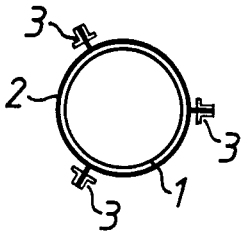

FIG. 3 shows the stack system in more detail. The guy wires 4 are linked to the guy rings 2 by means of lugs 5. The guy rings are fastened to three guy wires 4 arranged in a triangular configuration around the stack (FIG. 3*a*). The rings 2 are held in position by the three vertical struts 3 which are equi-spaced around the circumference of the stack (FIG. 3(*b*)).

Figure 4:
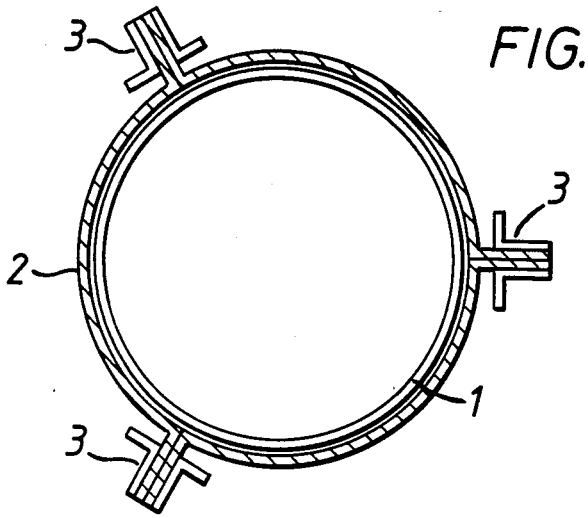
FIG. 4 shows a plan view on a typical horizonal ring and vertical strut assembly.
Figure 5:
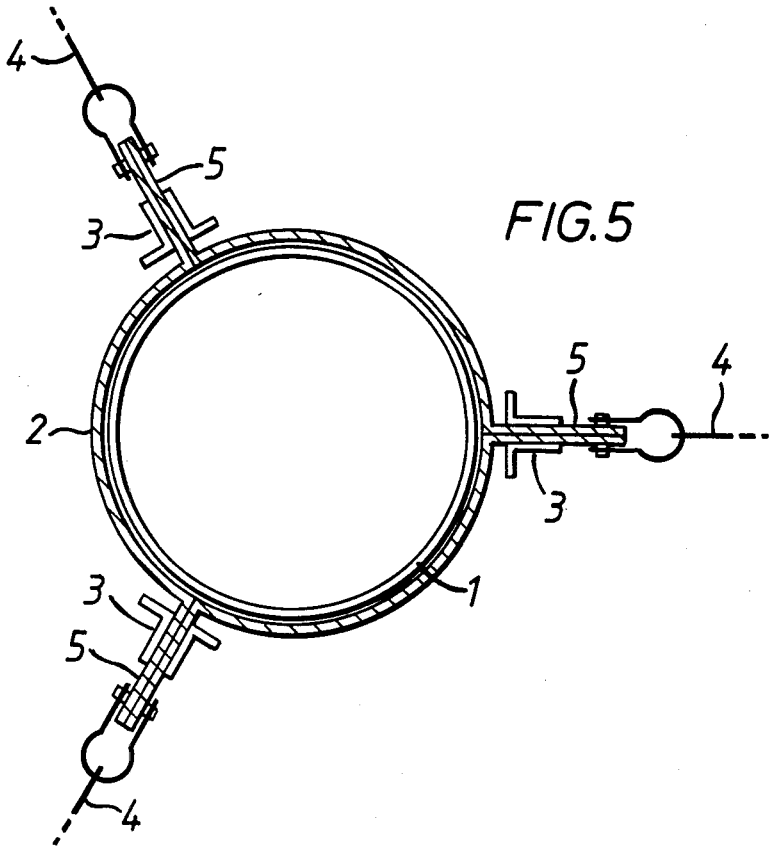
FIG. 5 shows a plan view on a typical horizontal ring at a guy connection position.

FIG. 4 shows the connection between the ring 2 and the equi-spaced vertical struts 3 around the stack 1. FIG. 5 shows the connection of the guy wires 4 through lug 5 to the vertical strut/ring arrangement.

FIG. 6 shows an embodiment of a stack system in which pairs of outwardly projecting guide struts 7 are welded to the stack 1. The struts 7 are arranged to lock against the vertical struts 3 of the stack system to resist torsional collapse or buckling of the stack 1. An alternative construction is to use plates instead of struts.

Bending moments and horizontal shear forces due to wind loads are resisted by the body of the stack.

Ladders, access platforms and other fittings and appurtenances may be attached to the stack, to the horizontal rings or to the vertical struts.

Service pipework, if required, may also be supported on the stack, on the horizontal rings or on the vertical struts.

A mechanical handling system for removal of the stack tip may be provided at the top of the stack.

The connections between the components of the stack system may be made by fully welding or partially welding and bolting together.

The horizontal rings and vertical struts may be fabricated from metal plate, rolled sections or tubulars depending on the size of the structure.

Under wind loading the outer surface of the stack will come into contact with the inner surface of some of the rings. The friction set up at these interfaces will act as a damping mechanism to suppress wind induced motion and dynamic instability. The level of the friction forces developed may be controlled by placing a resilient lining between some of the rings and the outer surface of the stack.

The stack system may be supported at its base on a pivot bearing or fixed foundation depending on the foundation conditions and functional requirements for the stack.

I claim:

1. A stack system comprising in combination a stack, one or more elongate struts extending along and being spaced apart from said stack, a plurality of rings spaced apart from each other and being attached to said struts, said rings encircling said stack, being located close to or touching said stack and not being attached to said stack, and a plurality of flexible guy wires attached to one or more of said rings or struts and to the ground.

2. A stack system according to claim 1 in which the vertical stack is a flare stack, a vent stack, a chimney or an aerial.

3. A stack system according to claim 1 which the elongate struts are equi-spaced around the stack.

4. A stack system according to claim 1 in which the rings are equi-spaced along the struts.

5. A stack system according to claim 1 having outward projections from the body of the stack, the projections being capable of engagement with the elongate struts so as to resist torsional collapse or buckling of the stack.

6. A stack system according to claim 5 in which the projections are struts or plates.

7. A stack system according to claim 5 or claim 6 in which one or more pairs of the outwardly projecting struts are located on the stack body, each pair of struts being capable of engagement with the elongate struts and an adjacent encircling ring.

* * * * *